US006413049B2

(12) United States Patent
Ogasawara

(10) Patent No.: US 6,413,049 B2
(45) Date of Patent: Jul. 2, 2002

(54) AXIAL FAN

(75) Inventor: Masayuki Ogasawara, Fuji (JP)

(73) Assignee: Usui Kokusai Sangyo Kaisha Limited (JP)

( * ) Notice: Subject to any disclaimer, the term of this patent is extended or adjusted under 35 U.S.C. 154(b) by 0 days.

(21) Appl. No.: 09/781,888

(22) Filed: Feb. 12, 2001

(51) Int. Cl.[7] ..... F04D 29/32
(52) U.S. Cl. ..... 416/188; 416/193 R
(58) Field of Search ..... 416/179, 182, 416/185, 188, 189, 192, 193 R

(56) References Cited

U.S. PATENT DOCUMENTS 1,147,658 A * 7/1915 Stukes ..... 416/192 X
2,616,511 A * 11/1952 Perrott ..... 416/193 R
3,131,236 A * 4/1964 Beehler et al. ..... 416/185 X
4,123,482 A * 10/1978 Wyatt et al. ..... 416/188 X
4,396,351 A * 8/1983 Hayashi et al. ..... 415/172 A
6,303,066 B1 * 10/2001 Steinmann ..... 416/175 X

* cited by examiner

*Primary Examiner*—John E. Ryznic
(74) *Attorney, Agent, or Firm*—Anthony J. Casella; Gerald E. Hespos

(57) ABSTRACT

To provide an axial fan of a high performance at a low cost and with a high fan efficiency.

An axial fan comprising a frusto-conical ring disposed on the downstream side of the fan. The frusto-conical ring is so mounted integrally with a fan boss on the open end portion on the trailing edge side of fan blades of the fan boss that it may not protrude from the trailing edges of the fan blades. In this frusto-conical ring, the taper angle, the external diameter and the mounting depth are set to such optimum values that the air flow having passed through the fan may neither separate nor flow backward.

1 Claim, 4 Drawing Sheets

AXIAL FAN

BACKGROUND OF THE INVENTION

1. Field of the Invention

The present invention relates to an axial fan driving directly by a driving shaft of an internal combustion engine or indirectly by a belt driving, oil hydraulics, motor driving or like and more particularly, to an axial fan having a ring for enlarging the discharge flow downstream of the fan.

2. Description of the Prior Arts

In recent years, the internal combustion engine for an automobile is provided a variety of accessories so that a resistance rises in the air flow to flow around the fan. These accessories are exemplified by not only a radiator but also a capacitor for an air conditioner, an inter cooler or an oil cooler on the front (or radiator) side of the fan in the engine room and by an alternator, a compressor for the air conditioner, a super charger and other accessories on the back (or engine) side of the fan.

As a result, the upstream resistance of the fan increases to reduce the air flow rate in a high resistance range. Where the upstream resistance of the fan is high, the flow on the downstream side of the fan is inclined. The flow velocity is the lower toward the center of the fan so that a region having a lower pressure than the atmospheric level is established on the downstream side of the central portion of the fan to allow a portion of the flow having passed through the fan to flow backward or to establish vortexes thereby to lower the fan performance. This phenomenon is the more prominent for the higher resistance on the upstream side of the fan.

In order to solve this problem, there has been proposed in Unexamined Published Japanese Utility Model Application No. 56-1921 the means for blocking that back flow by forming a flanged partition at the free end portion of the shroud of a radiator. With this reduced tip clearance, however, there arises another problem that the fan blades may collide against the shroud. In Unexamined Published Japanese Patent Application No. 59-176499, on the other hand, there has been proposed a bent axial fan which is enabled to prevent the separation of the air flow and to enhance the fan efficiency by forming a fan boss into an obliquely inclined convective contour shape. In Examined Published Japanese Patent Application No. 8-6713, moreover, there has been disclosed a bent axial fan in which the boss is formed into a frusto-conical shape and in which the correlations of the inclination of the boss and the width of the blades or the like are specified for the conditions of a radiator to reduce the power consumption but to increase the flow rate. However, the tapered boss in this bent axial fan has a complicated expensive molding die, when manufactured, to have defects that the manufacture cost is high and that it cannot be easily applied to the existing fan. In unexamined Published Japanese Utility Model Application No. 57-75199, moreover, there has been proposed a fan in which a conical guide (or ring) is mounted apart from the end face of a boss on the downstream side of the boss. However, this proposal is accompanied by a problem that the method of mounting the conical guide apart from the end face of the boss has found it seriously difficult to retain a space (or an axial length) for mounting the conical guide in the extremely restricted narrow space between the engine and the radiator.

SUMMARY OF THE INVENTION

The present invention has been conceived to solve the above-specified technical problems of the prior art and has an object to provide an axial fan of a high performance, which can effectively prevent the air flow having passed through the fan from separating and flowing backward and which has a lower cost and a higher fan efficiency than those of the bent axial fan of the prior art.

According to a gist of the invention, there is provided an axial fan mounted for rotations on one end of a drive shaft extending from an internal combustion engine, comprising: a frusto-conical (or conical) ring disposed on the downstream side of the fan, wherein the frusto-conical ring is so mounted integrally with a fan boss on the open end portion on the trailing edge side of fan blades of the fan boss that it may not protrude from the trailing edges of the fan blades, and wherein the frusto-conical ring satisfies the conditions of a taper angle $\theta$=45 to 80 degrees, a larger diameter Dmax=D×70% or less (D: the fan diameter), and a smaller diameter Dmin=the sum of the boss diameter dB+2 w (w: the mounting depth of the frusto-conical ring), and has the mounting depth w is no more than W×⅓ (W: the axial length of the entire boss), as taken in the axial direction from the open end face on the trailing edge side of the fan blades of the fan boss.

In the invention, the frusto-conical ring disposed on the downstream side of the fan is so mounted integrally with the boss on the trailing edge side of fan blades of the fan boss that it may not protrude outward from the trailing edges of the fan blades. This is: because the molding die can be simple and inexpensive and can have a short injection-molding time to lower the manufacture cost; because an easy application can be made to the existing fan; and because the frusto-conical ring is mounted not to protrude outward from the trailing edges of the fan blades so that it becomes unnecessary to retain the space (or the axial length) for mounting the frusto-conical ring in the extremely restricted narrow space between the engine and the radiator.

In the invention, on the other hand, the taper angle theta of the frusto-conical ring, the larger diameter Dmax, the smaller diameter Dmin and the mounting depth are set to $\theta$=45 to 80 degrees, the larger diameter Dmax=D×70% or less (D: the fan diameter), the smaller diameter Dmin=the sum of the boss diameter dB+2 w (w: the mounting depth of the frusto-conical ring), and the mounting depth w no more than W×⅓ (W: the axial length of the entire boss). These settings will be reasoned in the following.

The reason why the taper angle $\theta$ of the frusto-conical ring is set to 45 to 80 degrees is that the angle less than 45 degrees cannot attain the backflow preventing effect sufficiently whereas the angle more than 80 degrees may enlarge the larger diameter of the taper ring excessively to make the strength of the ring insufficient for the centrifugal force during the rotation of the fan.

The reason why the larger diameter Dmax of the frusto-conical ring is set to the fan diameter D×70% or less is that the radial efficiency of the propeller fan is mostly the highest in the vicinity of the portion of 75% of the fan diameter D so that the entire flow is seriously disturbed to lower the entire efficiency if the conical current portion is provided at that portion.

The reason why the smaller diameter of the frusto-conical ring is set to Dmin=the sum of the boss diameter dB+2 w (w: the mounting depth of the frusto-conical ring) is that the smaller diameter less than the value has a poor improving effect on the flow by the conical current portion so that the increase in the flow rate and the rise in the efficiency are hardly expected.

The reason why the ring mounting depth w is set to no more than W×⅓ (W: the axial length of the entire boss) is that if the ring mounting depth at the boss is so large as to exceed that value, the connection area of the fan blades to the boss is reduced to lower the strength of the blade roots thereby to degrade the duration reliability of the bending moment due to the tension or the high wind pressure by the high centrifugal force at a high-speed rotation.

The assembly means for the boss of the frusto-conical ring in the invention can be exemplified by bolts (or screws), a welding method or an adhering method. On the other hand, the material for the frusto-conical ring is generally exemplified by a resin material identical to that of the fan but may be exemplified by a light metal such as aluminum.

DETAILED DESCRIPTION OF THE PREFERRED EMBODIMENTS

Figure 1:
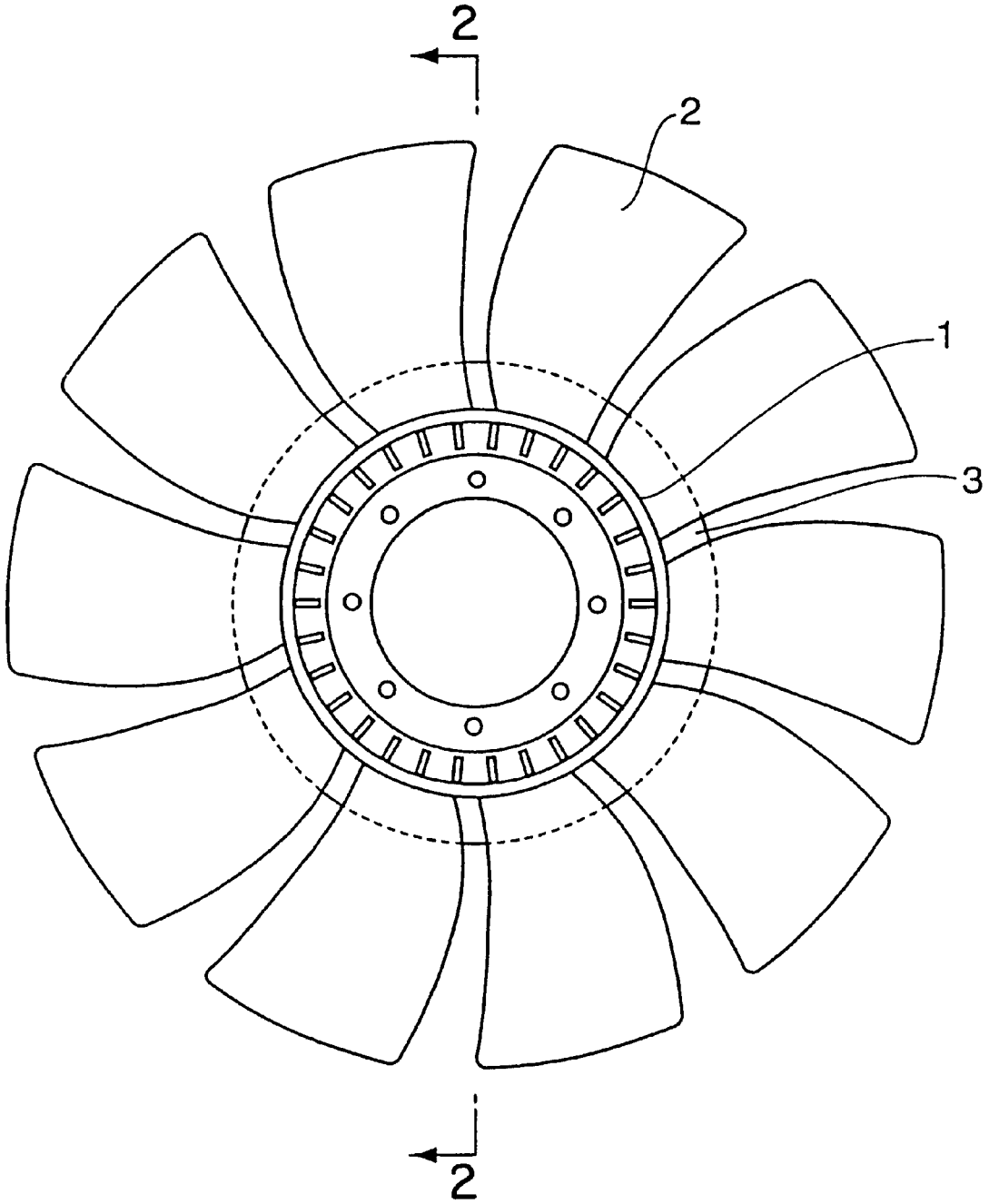
FIG. 1 is a front elevation showing one embodiment of an axial fan according to the invention.

In the invention: reference numeral 1 designates a fan boss; numeral 2 fan blades; numeral 3 a frusto-conical ring; and numeral 4 fastening bolts.

In the axial fan according to the invention, there are arranged on the outer circumference of the fan boss 1 a number of (usually four to ten) fan blades 2. This fan 1 is injection-molded of a synthetic resin material, such that the fan blades 2 are mounted at their root portions for the axial line on the boss on the boss at a predetermined angle of inclination and are so twisted from their root portions toward their leading end edges as to have a gradually smaller inclination.

With this construction, according to the invention, the frusto-conical ring 3 is so fastened by means of the fastening bolts 4 or the like to the open end portion on the downstream (or leeward) side of the fan boss 1 that it may not protrude outward from the trailing edges of the fan blades 2. The frusto-conical ring 3 is formed into such a conical shape as to have a diameter gradually enlarged downstream from the substantially equal diameter as that of the downstream open end face of the fan boss 1, and is fastened at its bottom portion to the downstream open end face of the fan boss 1 by means of the fastening bolts 4.

Here, the frusto-conical ring 3 is made to have a taper angle θ ranging 45 to 80 degrees, a larger diameter Dmax of 70% or less of the fan diameter D, and a smaller diameter Dmin of two times as large as the sum of the boss diameter dB+the mounting depth w of the ring 3. Moreover, the mounting depth w of the frusto-conical ring 3 is made no more than W×⅓ (W: the axial length of the entire boss), as taken in the axial direction from the open end face on the trailing edge side of the fan blades 2 of the fan boss 1.

Figure 2:
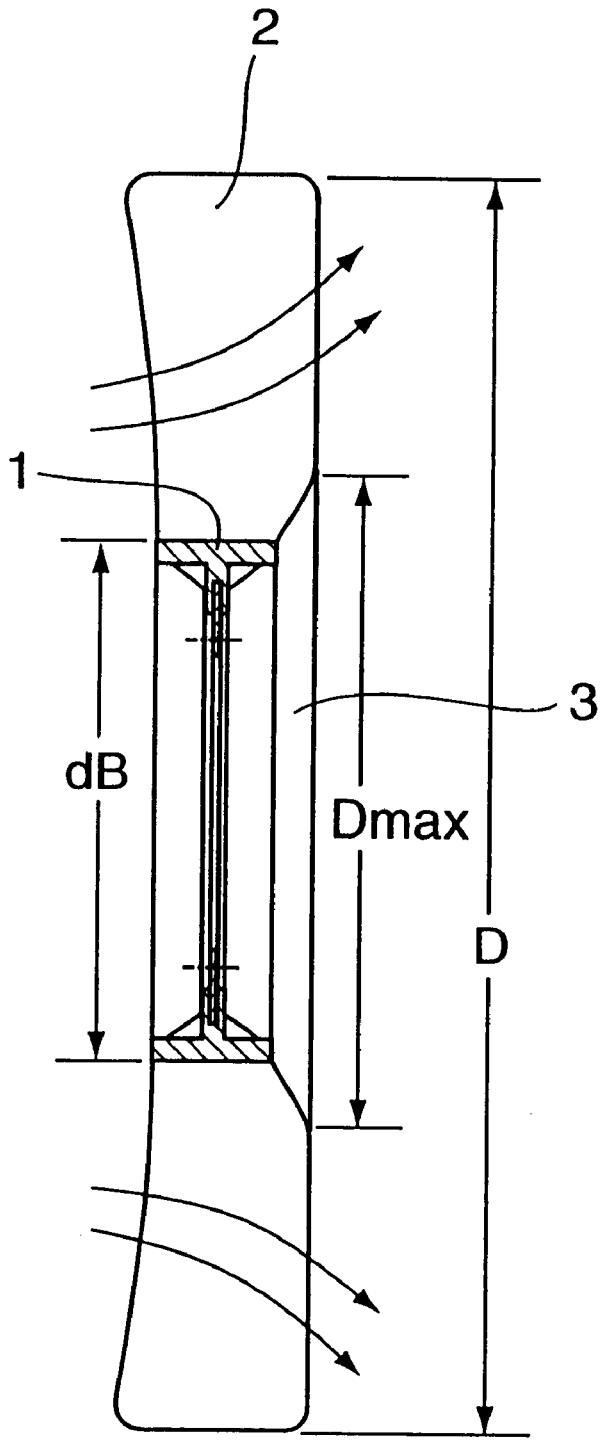
FIG. 2 is a longitudinally sectional side elevation taken along line 2—2 of FIG. 1.
Figure 3:
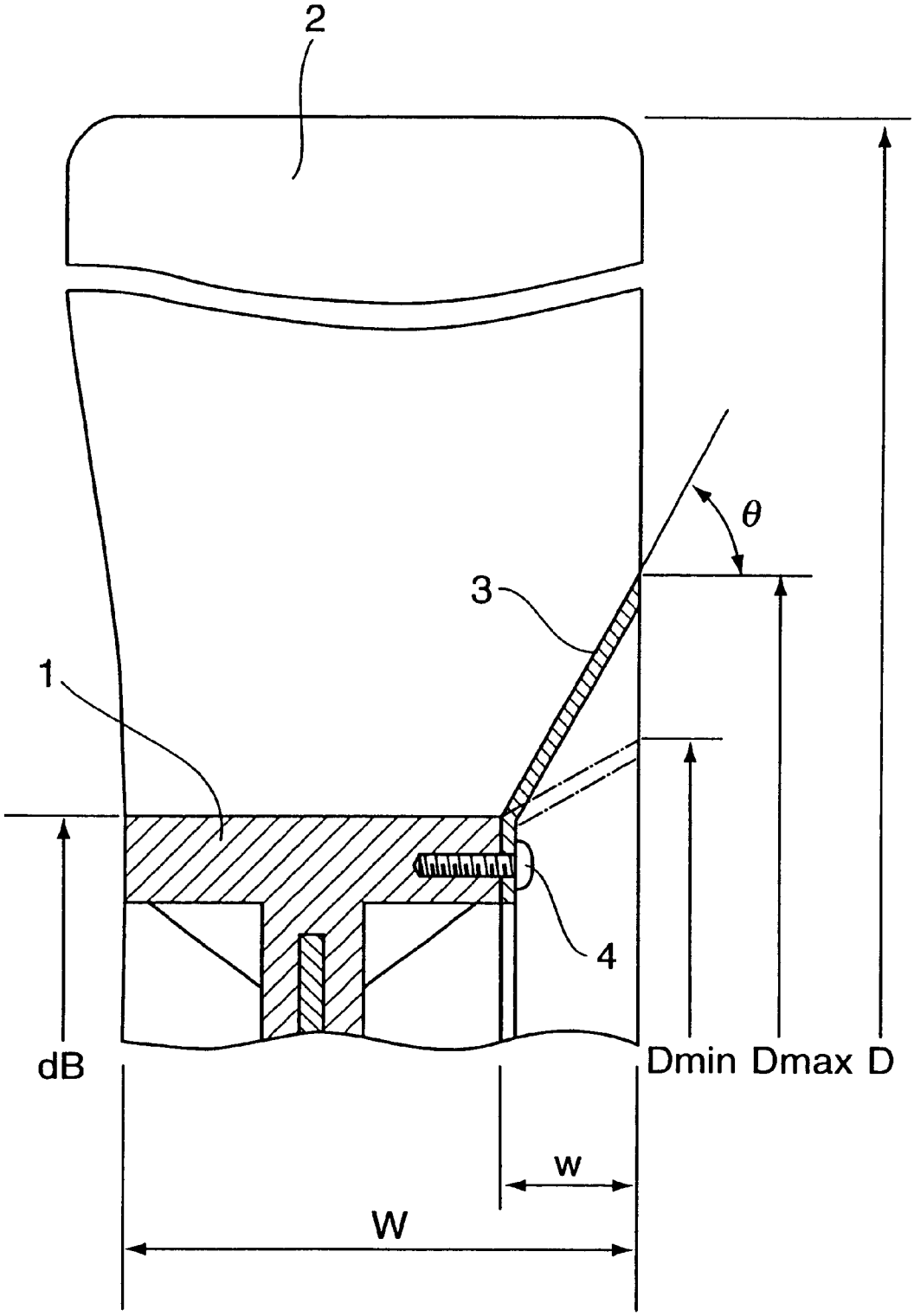
FIG. 3 is an enlarged sectional view of an essential portion of the axial fan.

In the axial fan thus constructed, the air flow to flow toward the fan blades 2, as indicated by solid arrows in FIG. 2, is so guided by the frusto-conical ring 3 mounted on the open end portion on the downstream (or leeward) side of the fan boss 1 that it is deflected radially outward. Therefore, the air can be freed from separation or backflow to establish a high flow rate even in a high-resistance area of 0.01 to 0.03.

As has been described hereinbefore, the axial fan of the invention, in which the frusto-conical ring is integrally mounted on the fan boss, can effectively prevent the flow having passed through the fan from separation or backflow, so that the absorbing horsepower can be reduced to enhance the fan efficiency. On the other hand, the frusto-conical ring, as disposed on the downstream side of the fan, is so integrally mounted on the boss that it may protrude outward from the trailing edges of the fan blades. As a result, the molding die is simplified in the construction and lowered in the cost so that the amortization of the mold or the molding time period can be shortened to lower the manufacture cost. Thus, it is possible to provide an axial fan of a high performance, which has a lower cost but a higher fan efficiency than those of the bent axial fan of the prior art. Moreover, a space (in the axial length) for mounting the frusto-conical ring need not be retained in the extremely restricted narrow space between the engine and the radiator. Another excellent effect is that the frusto-conical ring of the invention can be easily applied to the existing fan.

EXAMPLES

Figure 4:
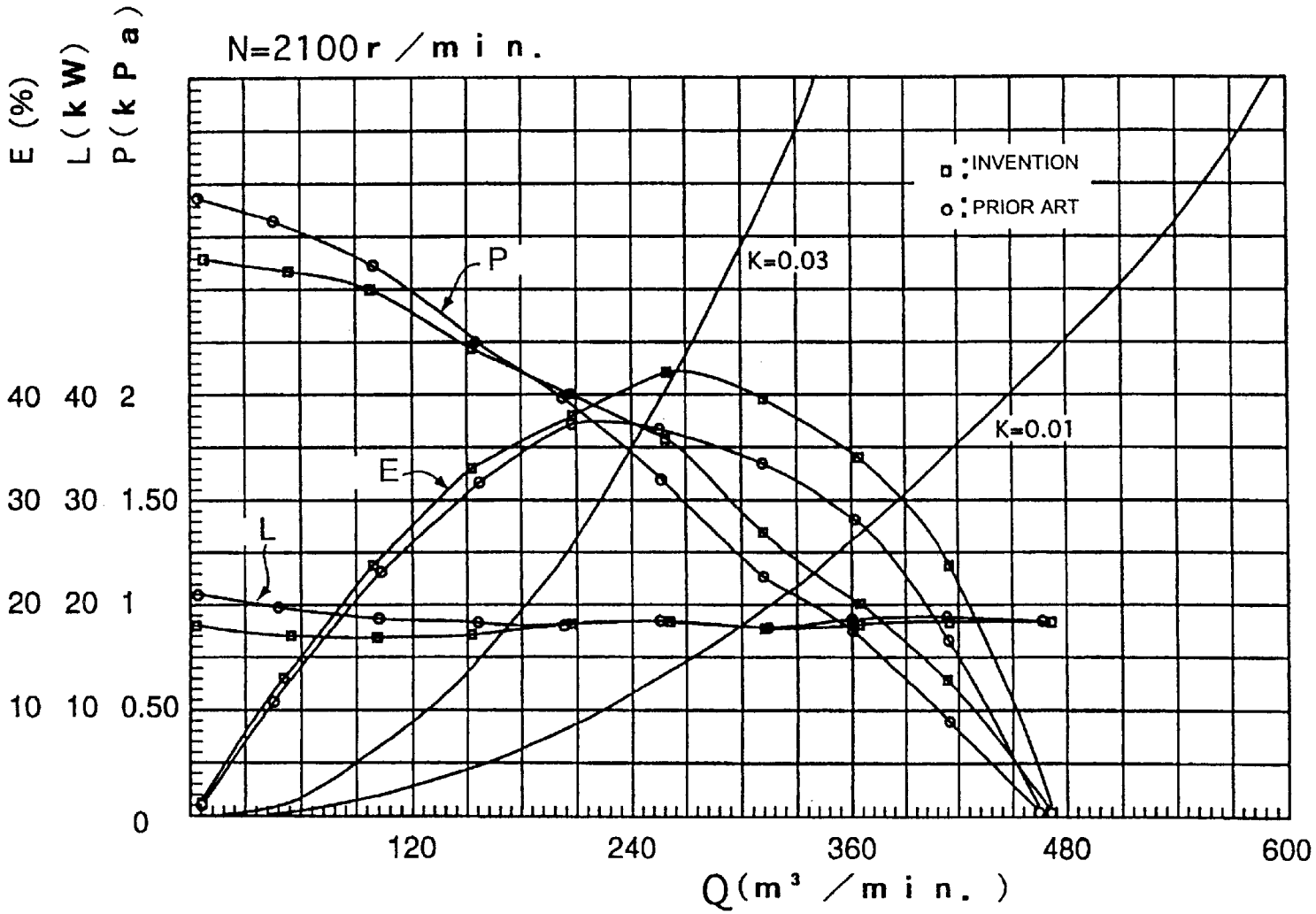
FIG. 4 is a diagram plotting the characteristic curves of the axial fan of the embodiment of the invention, as compared with those of the prior art.

FIG. 4 plots the experimental results on how an air flow rate Q, an absorbing horsepower L, a static pressure efficiency E and a static pressure P changed, as compared between the case (of the invention), in which the frusto-conical ring 3 shaped to have the highest fan efficiency was mounted, and the case (of the prior art) in which the same was not mounted. Here, the specifications of this embodiment are that the axial fan was injection-molded of polypropylene glass fibers to have the fan diameter D=720 mm, the fan blade width=95 mm, the fan boss diameter dB=310 mm, the frusto-conical ring taper angle θ=60 degrees, the larger diameter Dmax=420 mm, the boss entire axial length W=78 mm, and the ring mounting depth w =30 mm.

Here, the static pressure efficiency E is calculated by the following Formula:

$$E=100\times P\times Q/(60\times L\times 10^{-3}),$$

P:Pressure (Pa),

Q:Air Flow Rate (m3/min.), and

L:Horsepower (kW).

From the results of FIG. 4, it has been found out that in the (hatched) range of a ventilation resistance k of 0.01 to 0.03 employed most frequently in the axial fan of recent years, the axial fan of the invention with the frusto-conical ring 3 is higher in both the static pressure efficiency E and the static pressure P for the same absorbing horsepower than the axial fan of the prior art without the frusto-conical ring 3. From these results, there has been confirmed the effectiveness of the frusto-conical ring 3 which is so mounted integrally with the fan boss on the open end portion on the trailing edge side of the fan blades of the fan boss that it may not protrude from the trailing edges of the fan blades.

What is claimed is:

1. An axial fan mounted on one end of a drive shaft extending from an internal combustion engine and rotating through a directly rotating means or an indirectly rotating means, comprising:

a frusto-conical ring disposed on the downstream side of said fan, wherein said frusto-conical ring is so mounted integrally with a fan boss on the open end portion on the trailing edge side of fan blades of said fan boss that it may not protrude from the trailing edges of said fan blades, and wherein said frusto-conical ring satisfies the conditions of a taper angle θ=45 to 80 degrees, a larger diameter Dmax=D×70% or less (D: the fan diameter), and a smaller diameter Dmin=the sum of the boss diameter dB+2 w (w: the mounting depth of the frusto-conical ring), and has the mounting depth w is no more than W×⅓ (W: the axial length of the entire boss), as taken in the axial direction from the open end face on the trailing edge side of the fan blades of said fan boss.

* * * * *